US006821220B2

(12) United States Patent
Engler, Jr.

(10) Patent No.: US 6,821,220 B2
(45) Date of Patent: Nov. 23, 2004

(54) ANNULAR DART BODY WITH SPACED APART FLATS

(76) Inventor: Dennis D. Engler, Jr., 2572 Quail Run, Plainfield, IL (US) 60544

( * ) Notice: Subject to any disclaimer, the term of this patent is extended or adjusted under 35 U.S.C. 154(b) by 0 days.

(21) Appl. No.: 10/418,454

(22) Filed: Apr. 21, 2003

(65) Prior Publication Data

US 2004/0209717 A1 Oct. 21, 2004

(51) Int. Cl.[7] ..... A63B 65/02
(52) U.S. Cl. ..... 473/578; 473/614
(58) Field of Search ..... 473/573, 588, 473/569, 578, 614; 206/579, 315.1

(56) References Cited

U.S. PATENT DOCUMENTS 2,828,966 A * 4/1958 Swartz ..... 473/572
3,822,499 A * 7/1974 De Vos ..... 446/121
5,511,782 A * 4/1996 Maley ..... 473/569
5,531,450 A * 7/1996 Lu et al. ..... 273/348
5,707,308 A * 1/1998 Liu ..... 473/588

* cited by examiner

*Primary Examiner*—Jacob K. Ackun, Jr.
(74) *Attorney, Agent, or Firm*—Ernest Kettelson

(57) ABSTRACT

An annular dart carrying body and darts received thereon, in which the annular dart carrying body includes radially spaced apart dart receiving portions in which the dart receiving portions have flat portions positioned to come into full facing frictional contact with corresponding flat portions of each respective dart that is received in the dart receiving portions. The flat portions of the dart carrying body may comprise spaced apart cut away flat portions around the circumference of the dart carrying body. The flat portions of the dart carrying body may also be the flat bottom walls of respective recesses that open to the circumference of the dart carrying body to receive respective ones of the darts, with screw threads to enable screwing the darts into the respective recesses. The flat portions of each dart comprise a base portion having a flat bottom wall that comes into full facing frictional contact with the flat portions of the dart receiving portions of the dart carrying body when received therein.

11 Claims, 5 Drawing Sheets

ANNULAR DART BODY WITH SPACED APART FLATS

FIELD OF THE INVENTION

This invention relates to the field of dart games in which game darts are thrown at a game board. The darts in accordance with this invention are secured in radially spaced apart relationship to an annular dart body with their piercing ends facing outwardly for one of them to stick when the dart body with the darts is thrown at the game board in a manner that makes the dart body rotate or spin as it moves through the air. The spaced apart darts are secured to the outer circumference of the annular dart body by a threaded screw tip extending outwardly from the lower portion or base of each dart. To enable tightening down of each dart as it is screwed in place on the outer circumference of the annular dart body, spaced apart flats are provided around the circumference of the annular dart body, whereby the flat lower surface of the base of each dart comes into full facing relationship with each respective flat when each dart is screwed in place on the annular dart body.

BACKGROUND OF THE INVENTION

In many dart games, individual darts are thrown at the dart board. It is also known in the prior art to provide a dart body to which a plurality of darts are secured in spaced apart relationship, wherein such dart body is thrown at the target dart board in a manner that makes the dart body with multiple darts thereon rotate or spin so when it approaches the target board one of the darts has rotated to a position wherein its outer piercing end is facing the target board to pierce the target board on impact. Prior art multiple dart bodies of this type have a rounded circumferential surface, so the flat lower surface of the base portion of the dart cannot come into full facing relationship with such rounded circumferential surface and thus cannot be tightened down securely enough to hold the dart in place for a satisfactory length of time. The darts in such prior art multiple dart bodies become loose and fall out. The annular multiple dart body in accordance with the present invention solves that problem by providing the radially spaced apart flats around the circumference of the annular dart body at which to secure each of the respective darts.

SUMMARY OF THE INVENTION

The annular multiple dart assembly in accordance with this invention comprises a solid annular body of a suitable material such as wood, plastic or the like which the lower screw portion of the dart having a pointed end and an externally threaded shank can penetrate and hold the dart in place when tightened down. The solid annular body may also be of metal in which case a plurality of radially spaced apart internally threaded recesses are provided in which to receive respective ones of the externally threaded shanks of the darts.

In one embodiment of the invention the annular dart carrying body may have a hexagonal peripheral configuration, comprising six flat sides, to receive the lower screw portion of a dart at the midpoint of each flat side. Six darts are provided for such hexagonal dart carrying body. Each dart has an elongated mid-portion, a lance or piercing end piece at its outer end, and a base portion at its lower end. The base portion has an outwardly facing flat or planar surface, and a screw member extends from that outwardly facing flat or planar surface at the center thereof. The screw member has a sharply pointed outer end, and an externally threaded shank. The screw member of a respective dart is screwed into a respective one of the flat or planar sides of the hexagonal annular body at the midpoint of the flat side until the flat or planar surface of the dart base comes into full facing contact with the flat or planar surface of the respective flat or planar surface of the dart carrying body to which it is being affixed. The dart can then be tightened down to compress the respective flat surfaces into tight frictional engagement to prevent unintended loosening of the dart. When all six darts are thus affixed to the hexagonal dart carrying body, the assembly is ready for use.

The annular dart carrying body may have other peripheral configuration than hexagonal. It may be circular, with any desired number of radially spaced apart flats. The spaced apart flats may also be the bottom wall of internally threaded cylindrical recesses formed between spaced apart circular side walls of the dart carrying body which open outwardly to the circumference of the dart carrying body.

DESCRIPTION OF A PREFERRED EMBODIMENT

Figure 1:
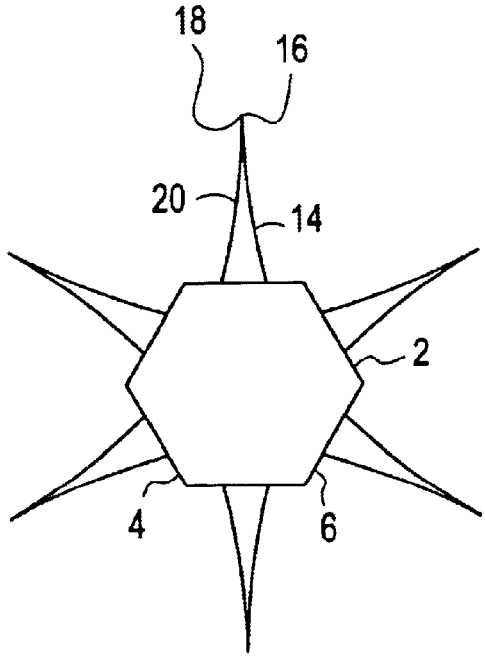
FIG. 1 is a plan view of a dart assembly in accordance with this invention showing an annular dart carrying body having a hexagonal peripheral configuration comprising six flat sides and showing six darts carried thereon, one extending from each flat side.
Figure 2:
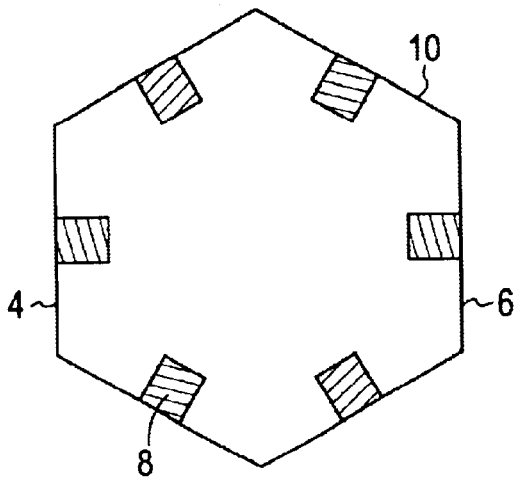
FIG. 2 is a section view taken on line 2—2 of FIG. 3.
Figure 3:
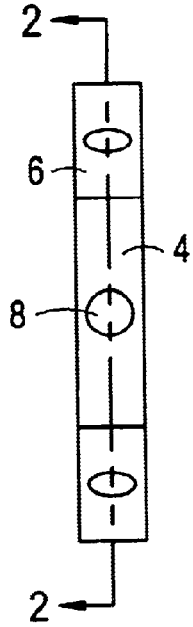
FIG. 3 is an end elevation view of an annular dart carrying body having a hexagonal peripheral configuration.
Figure 4:
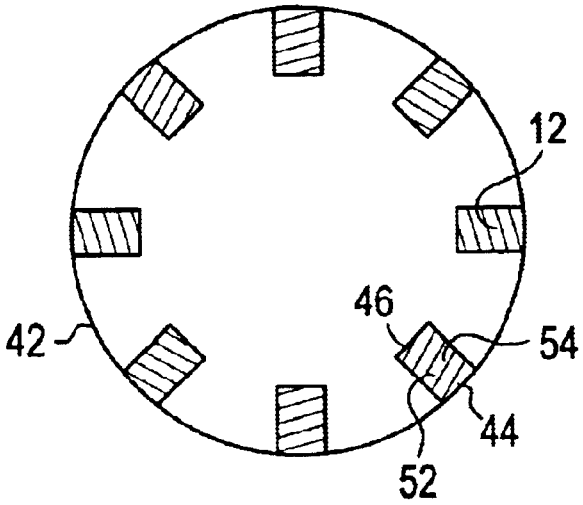
FIG. 4 is a section view taken on line 4—4 of FIG. 5.
Figure 5:
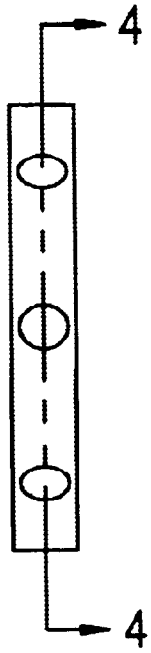
FIG. 5 is an end elevation view of an annular dart carrying body having a circular peripheral configuration.
Figure 6:
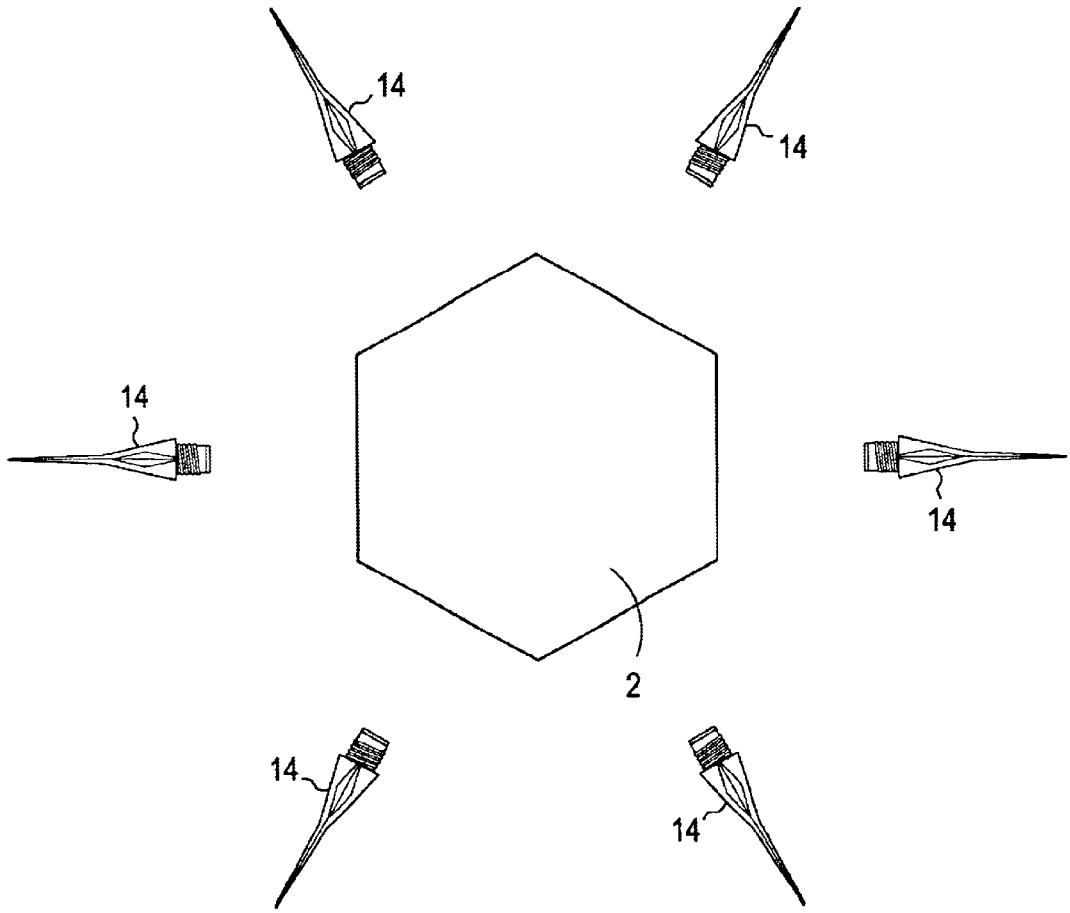
FIG. 6 is an exploded plan view of a hexagonal dart carrying body with six darts shown therearound in spaced apart relationship to the position on the dart carrying body to which they are to be secured.
Figure 7:
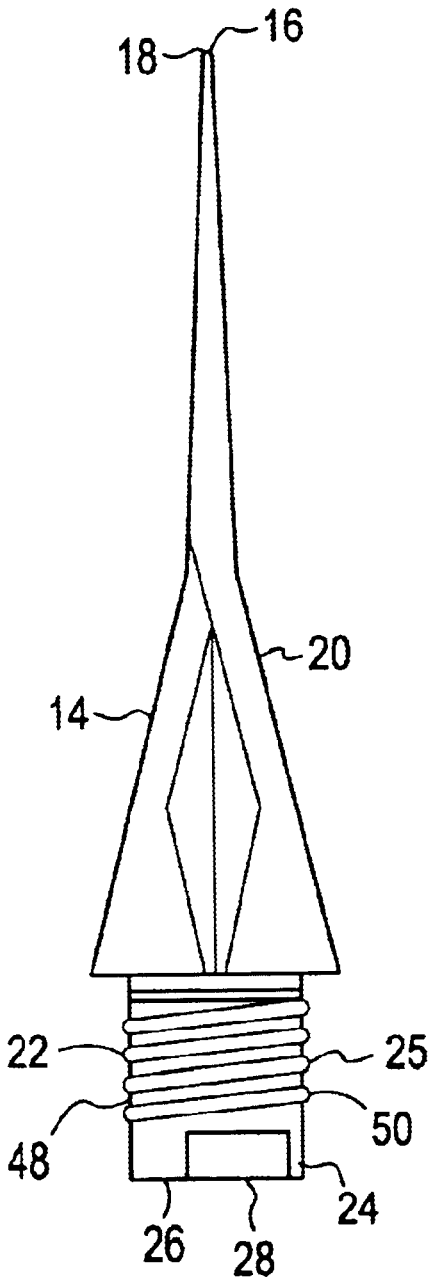
FIG. 7 is an enlarged elevation view of a dart for use in accordance with this invention.
Figure 8:
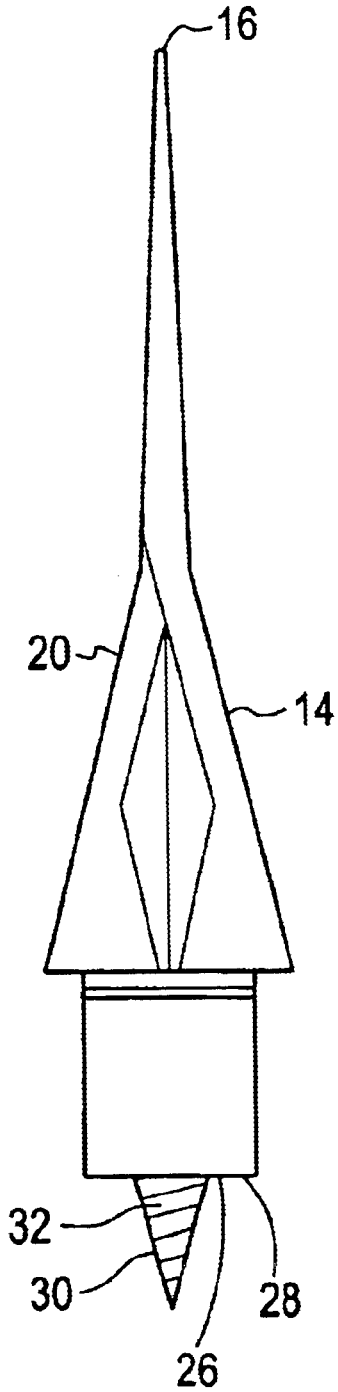
FIG. 8 is an enlarged elevation view of a modified dart for use in accordance with this invention.
Figure 9:
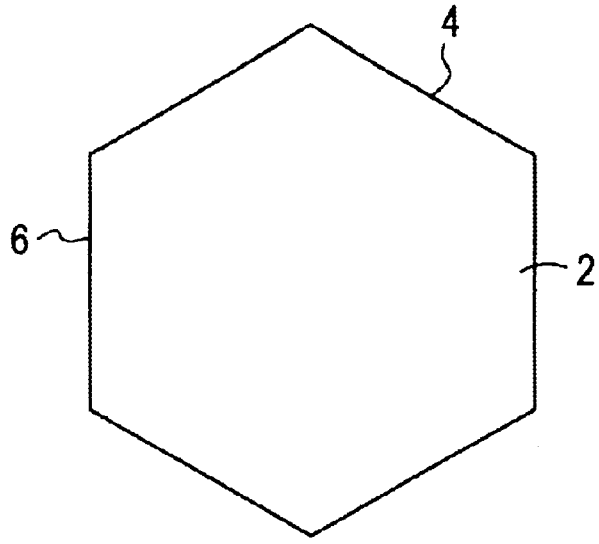
FIG. 9 is a plan view of an annular dart carrying body in accordance with this invention having a hexagonal peripheral configuration.
Figure 10:
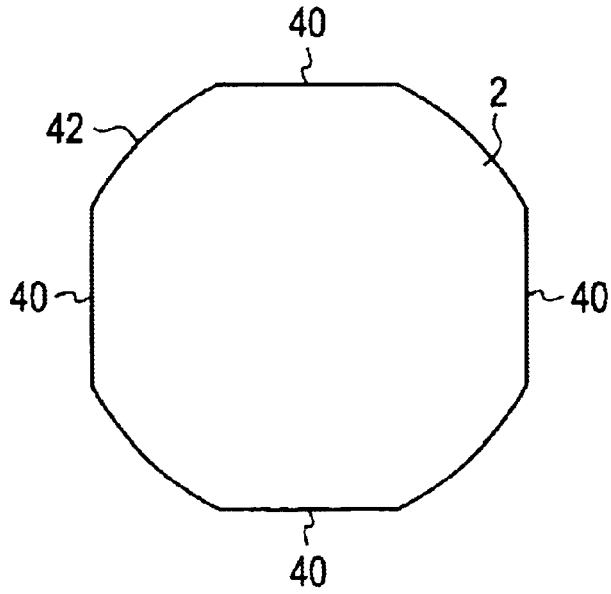
FIG. 10 is a plan view of an annular dart carrying body in accordance with this invention having a substantially circular peripheral configuration but with four cut away flat portions provided at radially spaced apart locations thereon.

A dart carrying body 2 is shown having a hexagonal peripheral configuration with six flat sides 4 each having a planar surface 6. A cylindrical recess 8 is provided at the midpoint of each flat side 4 opening to the outer circumference 10 of the dart carrying body 2. Each cylindrical recess 8 has an internally threaded cylindrical side wall 12.

Six darts 14 are provided for use with such hexagonal dart carrying body 2. Each dart 14 includes a lance or piercing member 16 at is upper end 18 which is secured to an elongated dart body portion 20 from which it extends. A base 22 is provided at the lower end 24 of each dart which may have an externally threaded cylindrical side wall 25. The base 22 includes a flat bottom wall 26 having an outwardly facing planar surface 28. In one modification, a screw member 30 extends outwardly from the center of the outwardly facing planar surface 28, having an outwardly threaded cylindrical shank 32 for reception in a respective one of the internally threaded cylindrical recesses 8.

The dart carrying body 2 may have other peripheral configurations than hexagonal. Its peripheral configuration may be circular with flats 40 provided at radially spaced apart locations. The flats 40 may be provided by cutting away a portion of the circular circumference 42. They may also be provided by drilling a cylindrical recess 44 inwardly from the circumference 42, such cylindrical recess 44 having a flat bottom wall 46 against which the flat bottom wall 26 of a dart 14 comes to rest in full facing relationship with the flat bottom wall 46 when the dart 14 is received in the cylindrical recess 44. The base 22 of the dart 14 may have external screw threads 48 on its cylindrical side wall 50, and the cylindrical side wall 52 of the cylindrical recess 44 may have corresponding internal screw threads 54 thereon to threadedly receive the dart 14 therein. When the dart is screwed into the cylindrical recess 44, it may be tightened down to be held securely in place when the flat bottom wall 26 of the dart 14 comes into full facing frictional contact and relationship with the flat bottom wall 46 of the cylindrical recess 44.

The darts 14 may be secured in place in the cylindrical recesses 44 by having a screw member 30 as described above extending from the bottom wall 26 of each dart 14 which is screwed into the body of the dart carrying body 2 when the sharp outer end of the screw member 30 comes into contact with the flat bottom wall 46 of the cylindrical recess 44. The dart 14 is rotated until its screw member 30 is screwed into the cylindrical recess 44 far enough for the flat bottom wall 26 of the dart 14 to come into full facing functional contact and relationship with the flat bottom wall 46 of the cylindrical recess 44 and then tightened down thereagainst.

I claim:

1. A dart in combination with a dart carrying body, said dart carrying body having an annular peripheral configuration with an annular circumference extending therearound to receive and carry a plurality of darts extending outwardly from said circumference, said dart carrying body including a plurality of dart receiving portions, at least one of said dart receiving portions including a flat surface positioned to face a portion of said dart received in said dart receiving portion.

2. A dart in combination with a dart carrying body as set forth in claim 1, wherein said annular peripheral configuration of said dart carrying body is circular.

3. A dart in combination with a dart carrying body as set forth in claim 1, wherein said annular peripheral configuration of said dart carrying body is hexagonal.

4. A dart in combination with a dart carrying body as set forth in claim 1, wherein said at least one of said dart receiving portions of said dart carrying body includes a flat surface positioned to face a portion of a said dart when said dart is received in said dart receiving portion.

5. A dart in combination with a dart carrying body as set forth in claim 1, wherein said at least one of said dart receiving portions includes a recess opening to said circumference of said dart carrying body and extending inwardly thereof for reception of a said dart in said recess, said recess having a flat bottom wall.

6. A dart in combination with a dart carrying body as set forth in claim 5, wherein said recess is cylindrical.

7. A dart in combination with a dart carrying body as set forth in claim 6, wherein said cylindrical recess includes an internally threaded cylindrical side wall.

8. A dart in combination with a dart carrying body as set forth in claim 5, wherein said dart carrying body comprises an annular portion of material in which a screw can be threaded, tightened down and held, said annular portion extending inwardly from said circumference, said flat bottom wall of said recess having a portion thereof adapted to receive a threaded screw portion of a dart to hold it tightly in place when said dart is screwed into said recess and tightened down against said flat bottom wall of said recess.

9. A dart carrying body having a plurality of dart receiving portions in combination with a plurality of darts for reception by respective ones of said plurality of dart receiving portions, a bottom wall of each of said dart receiving portions, said bottom wall having a flat surface, wherein at least one of said plurality of darts includes a sharp outer end portion, an elongated body portion extending inwardly from said sharp outer end, and a lower end portion extending from said elongated body portion, said lower end portion having a flat bottom end portion facing outwardly from said lower end portion positioned for full facing frictional contact with at least a portion of said flat surface of said bottom wall of said at least one of said dart receiving portions of said dart carrying body when said at least one of said plurality of darts is received therein.

10. A dart carrying body in combination with a plurality of darts as set forth in claim 9, wherein each of said darts includes a lower end portion, wherein said lower end portion of at least one of said darts includes a cylindrical base member, said cylindrical base member including an externally threaded cylindrical side wall, said at least one of said dart receiving portions including a cylindrical recess having an internally threaded cylindrical side wall to threadedly receive said externally threaded side wall of said base member, said cylindrical recess having said flat surface of said bottom wall, said cylindrical base member having a flat bottom wall for full facing frictional contact and relationship with said flat surface of said bottom wall of said cylindrical recess when threadedly received therein.

11. A dart carrying body in combination with a plurality of darts as set forth in claim 10, wherein said at least one of said plurality of darts includes a screw member extending outwardly from said flat bottom wall of said lower portion of said dart, and wherein said dart carrying body is comprised of a material in which said screw member can be received, tightened down and held.

* * * * *